US006000156A

United States Patent [19]

Chern et al.

[11] Patent Number: 6,000,156

[45] Date of Patent: Dec. 14, 1999

[54] STRUCTURE OF A HEATING DRUM FOR IRONING MACHINES

[76] Inventors: Jing Shing Chern; Wan-Chin Tung, both of P.O. Box 82-144, Taipei, Taiwan

[21] Appl. No.: 09/139,403

[22] Filed: Aug. 25, 1998

[51] Int. Cl.[6] ..... D06F 67/04

[52] U.S. Cl. ..... 38/44; 100/92

[58] Field of Search ..... 38/44, 16, 66, 38/11, 45, 49, 50, 52, 58, 59, 62; 100/38, 92, 106, 110, 116, 117, 121, 125, 127; 29/895, 895.213, 895.22

[56] References Cited

U.S. PATENT DOCUMENTS

| | | | |
|---|---|---|---|
| 2,507,029 | 5/1950 | Lundy | 38/66 |
| 3,808,966 | 5/1974 | Busch | 100/106 |
| 4,106,404 | 8/1978 | Schmid | 100/117 |
| 4,418,486 | 12/1983 | Kober | 38/58 |
| 4,562,655 | 1/1986 | Bosshart et al. | 38/52 |
| 4,757,582 | 7/1988 | Verkasalo | 29/895 |
| 4,965,920 | 10/1990 | Smith | 38/44 X |

*Primary Examiner*—Ismael Izaguirre
*Attorney, Agent, or Firm*—A & J

[57] ABSTRACT

A heating drum for ironing machines includes a metallic hollow cylindrical body having two enlarged ends to form two water reservoirs and two coaxial tubular necks at the two enlarged ends, the metallic hollow cylindrical body having a plurality of inverted V-shaped grooves each having two ends communicating with the water reservoirs an a tip pointing to a direction along which the metallic hollow cylindrical body rotates.

1 Claim, 7 Drawing Sheets

STRUCTURE OF A HEATING DRUM FOR IRONING MACHINES

BACKGROUND OF THE INVENTION

1. Field of the Invention

This invention is related to an improved structure of a heating drum for ironing machines.

2. Description of the Prior Art

Referring to FIGS. 1, 2 and 3, the conventional ironing machine generally includes a heating drum 1, a plurality of rollers 2, a canvas strap 3, a driving mechanism, and a steam generator.

The heating drum 1 is a metallic hollow cylindrical member and formed with two tubular members 120 at two ends which are connected to the driving mechanism and steam generator respectively so that the heating drum 1 will be driven to rotate at a constant speed and heated by the steam to produce heat temperature on its outer surface. An end of the heating drum 1 is provided with a drain hole 11. The rollers 2 are arranged around the heating drum 1 for guiding the canvas strap 3 thereby making the it act as a conveyor belt for transmitting bedsheets, clothes and the like to the outer surface of the heating drum 1 for ironing.

However, the heating drum 1 is of a smooth inner surface so that when the steam is cooled, it will be condensed into water drops which will then be accumulated at the bottom of the heating drum 1. Then, the heat of the steam passing through the heating drum 1 will be absorbed by the water thereby lowering the temperature of the steam and making it impossible to raise the temperature at the outer surface of the heating drum 1 to a desired value. The maximum temperature at the outer surface of the conventional heating drum is generally around 90–95° C. thus making the clothing impossible to be dried completely.

SUMMARY OF THE INVENTION

This invention is related to an improved structure of a heating drum for ironing machines.

It is the primary object of the present invention to provide an improved heating drum for ironing machines which can dry clothing completely.

It is another object of the present invention to provide an improved heating drum for ironing machines which can be heated to 165° C.

It is another object of the present invention to provide an improved heating drum for ironing machines which can let out water drops automatically.

It is still another object of the present invention to provide an improved heating drum for ironing machines which is simple in construction.

It is a further object of the present invention to provide an improved heating drum for ironing machines which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
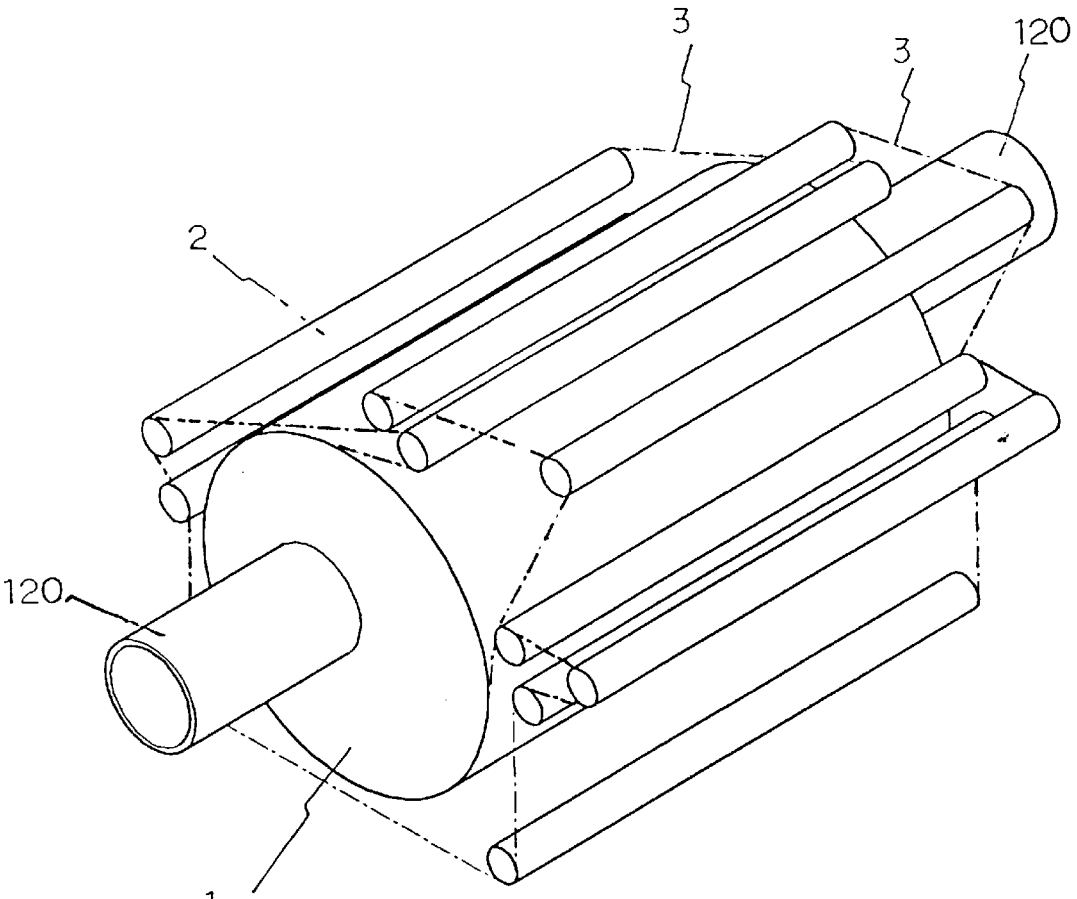
(PRIOR ART) FIG. 1
FIG. 1 is a perspective view of a prior art ironing machine.
Figure 2:
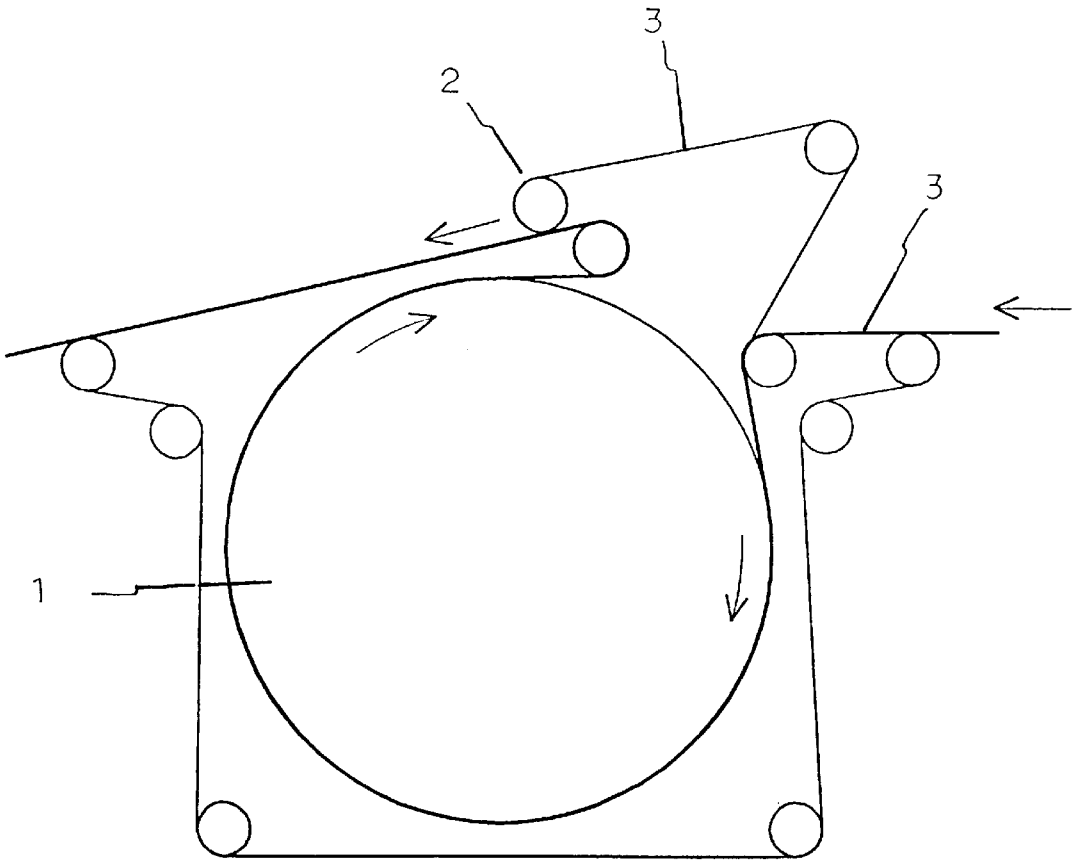
(PRIOR ART) FIG. 2
FIG. 2 is a side view of the prior art ironing machine.
Figure 3:
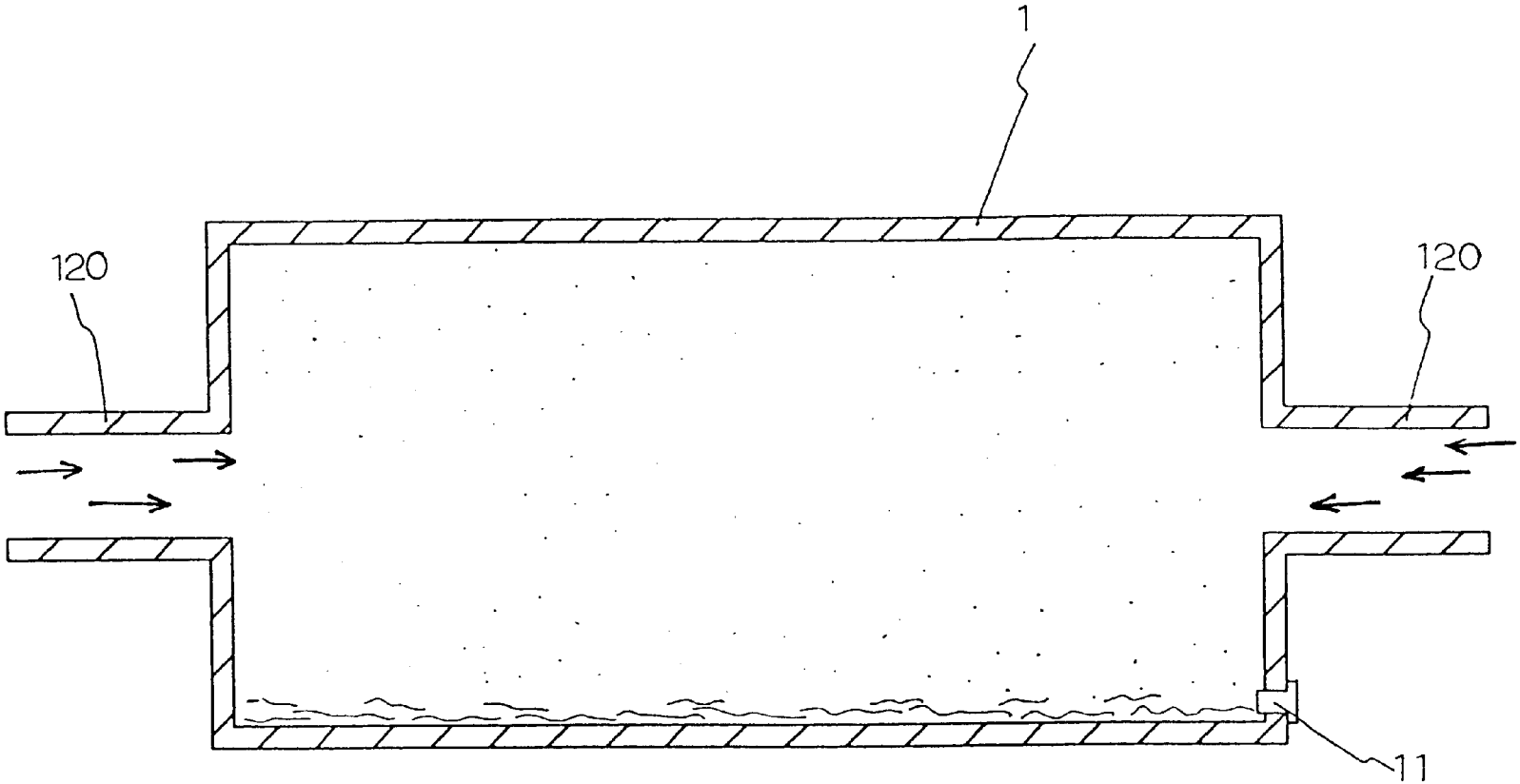
(PRIOR ART) FIG. 3
FIG. 3 is a sectional view of the heating drum of the prior art ironing machine.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 4:
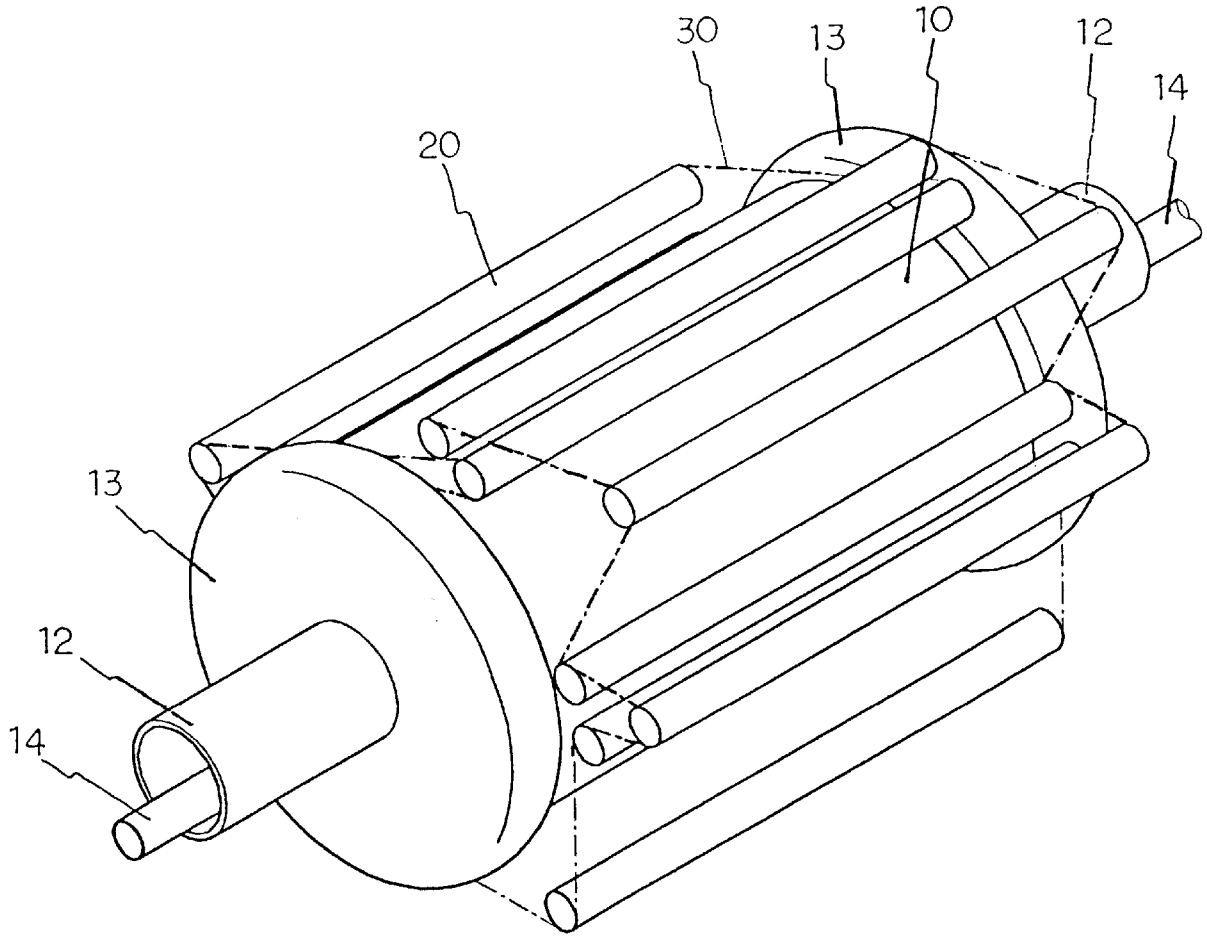
FIG. 4 is a perspective view of an ironing machine according to the present invention.
Figure 5:
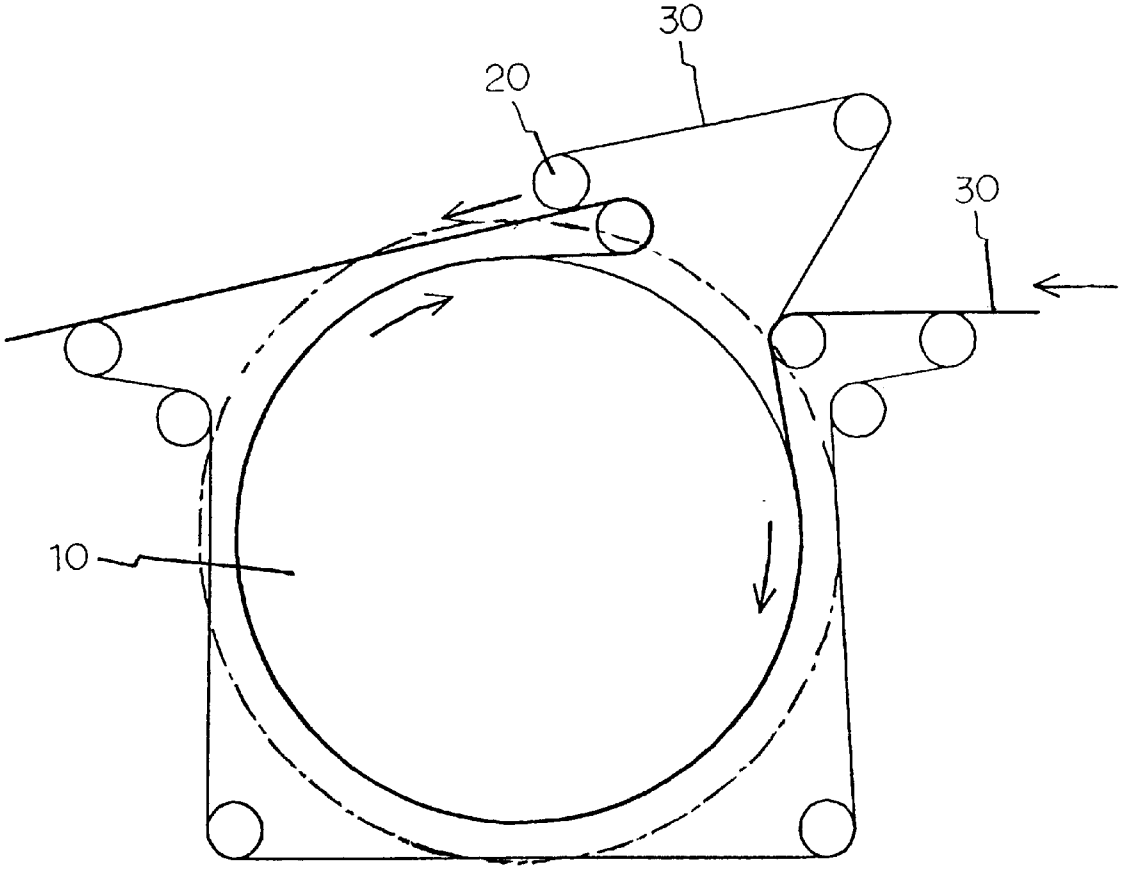
FIG. 5 is a side view of the present invention.
Figure 6:
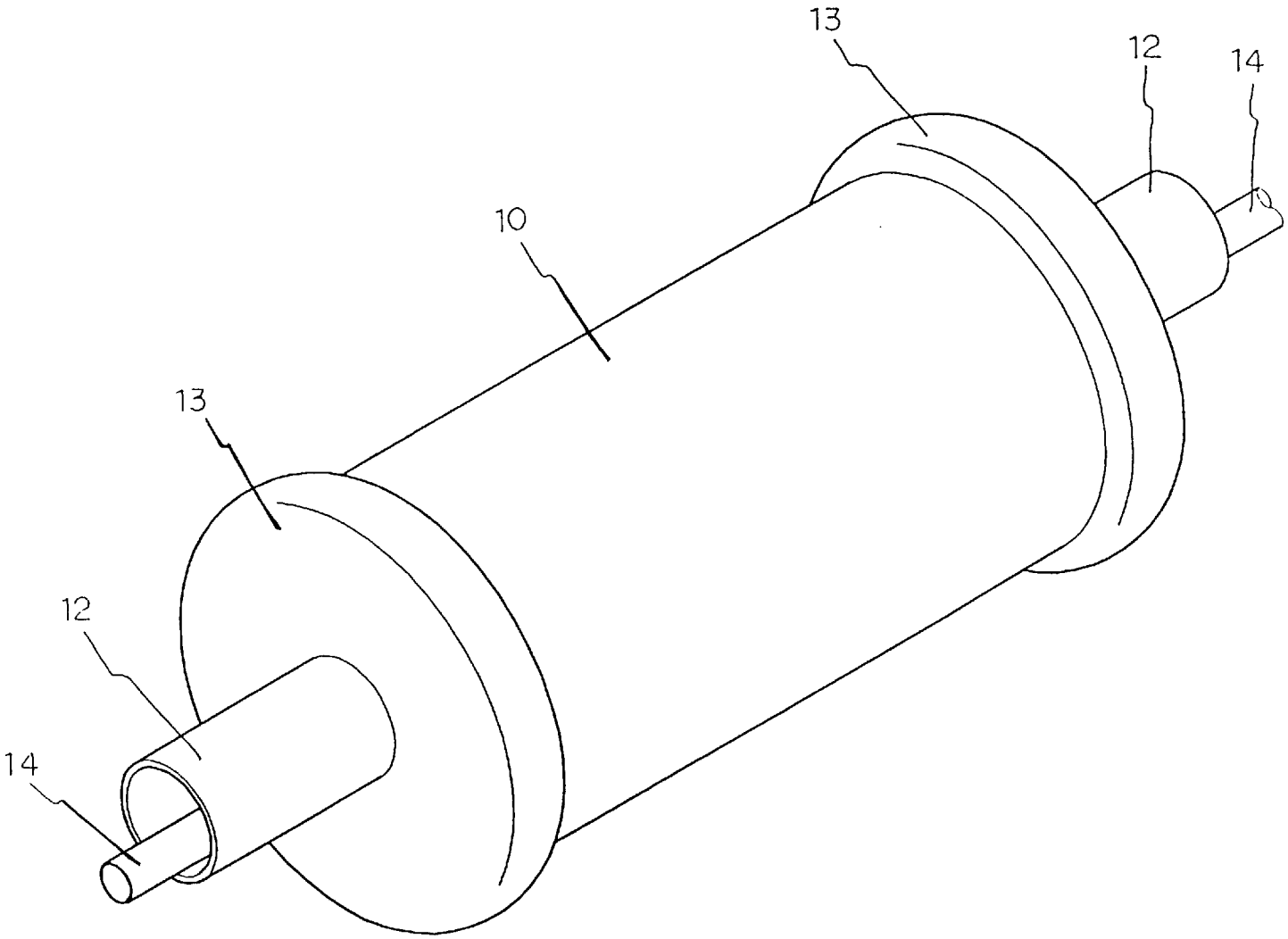
FIG. 6 is a perspective view of the heating drum according to the present invention.
Figure 7:
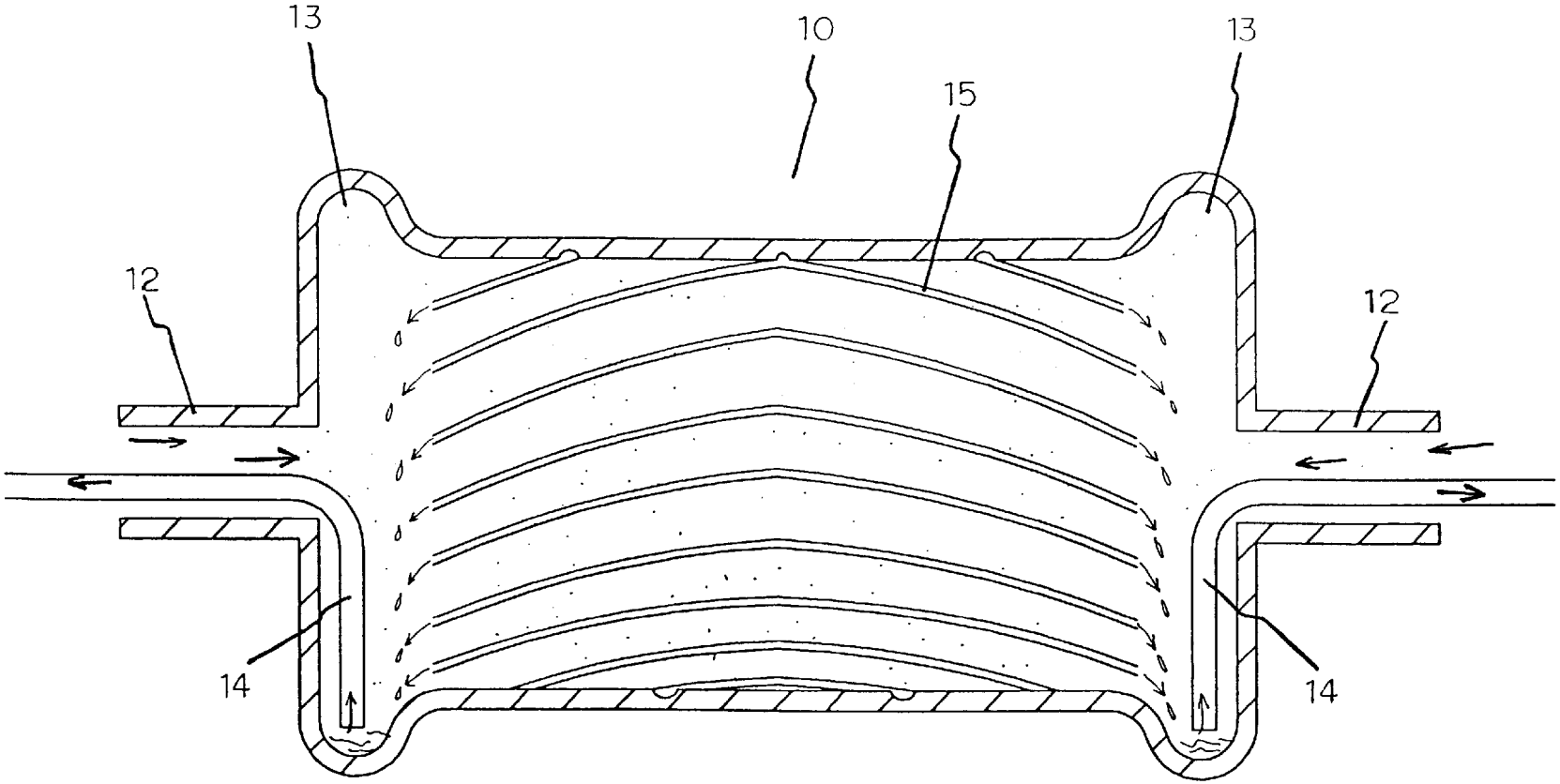
FIG. 7 is a sectional view of the heating drum according to the present invention.

With reference to the drawings and in particular to FIGS. 4, 5 and 6 thereof, the ironing machine according to the present invention generally comprises a heating drum 10, a plurality of rollers 20, a canvas strap 30, a driving mechanism and a steam generator.

The heating drum 10 has a metallic hollow cylindrical body with two enlarged ends to from two water reservoirs 13 and two coaxial necks 12 at two ends thereof. The inner side of the metallic hollow cylindrical body has a plurality of inverted V-shaped grooves 15 each having two ends communicating with the water reservoirs 13 and a tip pointing to a direction along which the metallic hollow cylindrical body rotates. Each of the water reservoirs 13 is connected with a draining pipe 14 for transmitting water out thereof. The two tubular necks 12 of the heating drum 10 are connected to the driving mechanism and steam generator respectively so that the heating drum 10 will be driven to rotate at constant speed and heated by the steam to produce high temperature on its outer surface. The driving mechanism and steam generator may be of any conventional design well known to those skilled in art and is not considered a part of the invention.

The rollers 20 are installed around the heating drum 10 for guiding the canvas strap 30 thereby making the it act as a conveyor belt for transmitting bedsheets, clothes and the like to the outer surface of the heating drum 10 for ironing.

The canvas strap 30 is arranged on the rollers 20 and the heating drum 10 so that it will move the clothing thereon to go forward when the rollers 20 and the heating drum 10 are rotated.

The driving mechanism (not shown) includes a motor (not shown) and transmission gears (not shown) for driving the heating drum 10 to rotate at a constant speed.

The steam generator (not shown) has an outlet (not shown) connected to one of the tubular necks 2 of the heating drum 10 for supplying high temperature steam therein.

When in use, the clothing (not shown) is arranged on the canvas strap 30 and the rollers 20 will drive the canvas strap 30 to convey the clothing tightly on the outer surface of the heating drum 10. In the meantime, the steam generator supplies high temperature steam into the heating drum 10 thereby raising the temperature on its outer surface and therefore enabling the clothing to be ironed and dried. As the steam condenses into water drops, they will be first collected in the inverted V-shaped grooves 15 and then guided into the water reservoirs 13 at two ends of the heating drum 10. As the pressure inside the heating drum 10 is higher than that outside the heating drum 10, the water collected in the water reservoirs 13 will be transmitted out of the water reservoirs 13 through the two draining pipes 14. Hence, the temperature inside the heating drum 10 will be raised up to 165° C. so that when the clothing tightly arranged on the heating drum 10 is rotated for a cycle, the clothing will be ironed and completely dried.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A heating drum for ironing machines comprising: a metallic hollow cylindrical body having two enlarged ends to form two water reservoirs and two coaxial tubular necks at said two enlarged ends, said metallic hollow cylindrical body having a plurality of inverted V-shaped grooves each having two ends communicating with said water reservoirs an a tip pointing to a direction along which said metallic hollow cylindrical body rotates.

* * * * *